US006030245A

United States Patent [19]

Choy

[11] Patent Number: 6,030,245

[45] Date of Patent: Feb. 29, 2000

[54] CONNECTOR WITH HYBRID LATCH DEVICE

[75] Inventor: Edmond Choy, Union City, Calif.

[73] Assignee: Hon Hai Precision Ind. Co., Ltd., Taipei Hsien, Taiwan

[21] Appl. No.: 09/039,165

[22] Filed: Mar. 13, 1998

[51] Int. Cl.[7] ..... H01R 13/62

[52] U.S. Cl. ..... 439/328; 439/326

[58] Field of Search ..... 439/325–328, 439/629, 630

[56] References Cited

U.S. PATENT DOCUMENTS

| | | | |
|---|---|---|---|
| 5,718,594 | 2/1998 | Tondreault et al. | 439/326 |
| 5,769,668 | 6/1998 | Tondreault | 439/326 |
| 5,803,761 | 9/1998 | Mochizuki | 439/326 |
| 5,860,825 | 1/1999 | Yodogawa | 439/326 |
| 5,888,086 | 3/1999 | Yaegashi et al. | 439/326 |

*Primary Examiner*—Hein Vu

[57] ABSTRACT

An electrical connector (10) includes an insulative housing (12) defining a central slot (14) for receiving a module (100) therein. A plurality of contacts are disposed by two side of the central slot (14). A pair of platforms (18) are provided at two ends of the housing (12). A latch device (22) provided adjacent to each corresponding platform, includes a plastic member (24) with a locking head (48) integrally extending by the outside of said platform (18), and a metal member (26) including a resilient body (36) positioned by the outside of the plastic member (24), wherein both the resilient bodies (36) of the metal members (26) at two opposite ends of the housing (12) are substantially exposed to an exterior and commonly define the maximum lengthwise dimension of the connector (12), so that the full lengthwise dimension of the connector (10) can be reduced for miniaturization. Additionally, an engagement structure between the plastic member (24) and the metal member (26) for collaboration in releasable latching performance of the latch device (22), is disposed under the locking head (48) of the plastic member (24) and substantially in the notch (102) on the side edge of the inserted module (100) for avoiding any interference with the inserted module (100).

11 Claims, 4 Drawing Sheets

CONNECTOR WITH HYBRID LATCH DEVICE

BACKGROUND OF THE INVENTION

1. Field of the Invention

The invention relates to the electrical connector for receiving the module therein, and particularly to the connector having latch devices on two ends for releasably latching the module therein.

2. The Related Art

The copending application Ser. No. 08/627,143 filed Apr. 3, 1996 now U.S. Pat. No. 5,759,057 discloses a connector for horizontally receiving therein a module wherein a pair of latch devices are provided adjacent two opposite ends of the housing of the connector for releasably latching the module in position with regard to the housing of the connector. Anyhow, since such connector is used in a notebook computer, it is desired to reduce the dimension along the lengthwise direction of the connector, thus resulting in either the dimension of the whole computer set can be minimized or other electrical components can be disposed by the side thereof for not increasing the original dimension of the main board of the computer on which the connector and the electrical components are mounted.

Therefore, in the previous design, a cavity is formed on either end of the housing to receive a corresponding metal member therein for cooperation with the plastic member for commonly efficiently and reliably retainably latching the module in position. As understood, under the aforementioned miniaturization trend, it is expected to reduce the lengthwise dimension of the housing, and thus removal of the original end wall of the housing and exposing the metal member to be the outermost part of the connector housing, are designedly implemented in the invention for achievement of the miniaturization.

Secondly, in the previous design, a U-shaped structure is provided on each metal member to form a space therebetween for receivably engagement with the plastic member. It is noted that ideally the plastic member should provide a straight inner surface for abutment with the corresponding side edge of the module so that the module can be properly retained in position in the lengthwise direction. While in the previous design, such an inner wall of the U-shaped structure of the metal member, which is substantially disposed on the inner side of the inner surface of the plastic member and owns its substantial thickness, may somewhat interfere with the side edge of the module if there is no offset provided on the plastic member for compensating the thickness of the inner wall of the U-shaped structure, or if the inner surface of the plastic member does not extend obliquely/outwardly to provide sufficient space around its distal end for compensation of the thickness of the inner wall of the U-shaped structure of the metal member.

Accordingly, an object of the invention is to provide a connector with latch devices, wherein a portion of each end wall of the housing is removed and the metal member defines the outermost end of the connector, so that the whole lengthwise dimension is minimized or reduced.

Additionally, another object of the invention is to provide an engagement structure between the metal member and the plastic member without interfering with the inserted module during insertion or withdrawal of the module with regard to the connector.

SUMMARY OF THE INVENTION

According to an aspect of the invention, an electrical connector includes an insulative housing defining a central slot for receiving a module therein. A plurality of contacts are disposed by two side of the central slot. A pair of platforms are provided at two ends of the housing. A latch device provided adjacent to each corresponding platform, includes a plastic member with a locking head integrally extending by the outside of said platform, and a metal member including a resilient body positioned by the outside of the plastic member, wherein both the resilient bodies of the metal members at two opposite ends of the housing are substantially exposed to an exterior and commonly define the lengthwise dimension of the connector, so that the full lengthwise dimension of the connector can be reduced for miniaturization.

Additionally, an engagement structure between the plastic member and the metal member for collaboration in releasable latching performance of the latch device, is disposed under the locking head of the plastic member and substantially in the notch on the side edge of the inserted module for avoiding any interference with the inserted module.

DETAILED DESCRIPTION OF THE PREFERRED EMBODIMENTS

Figure 1:
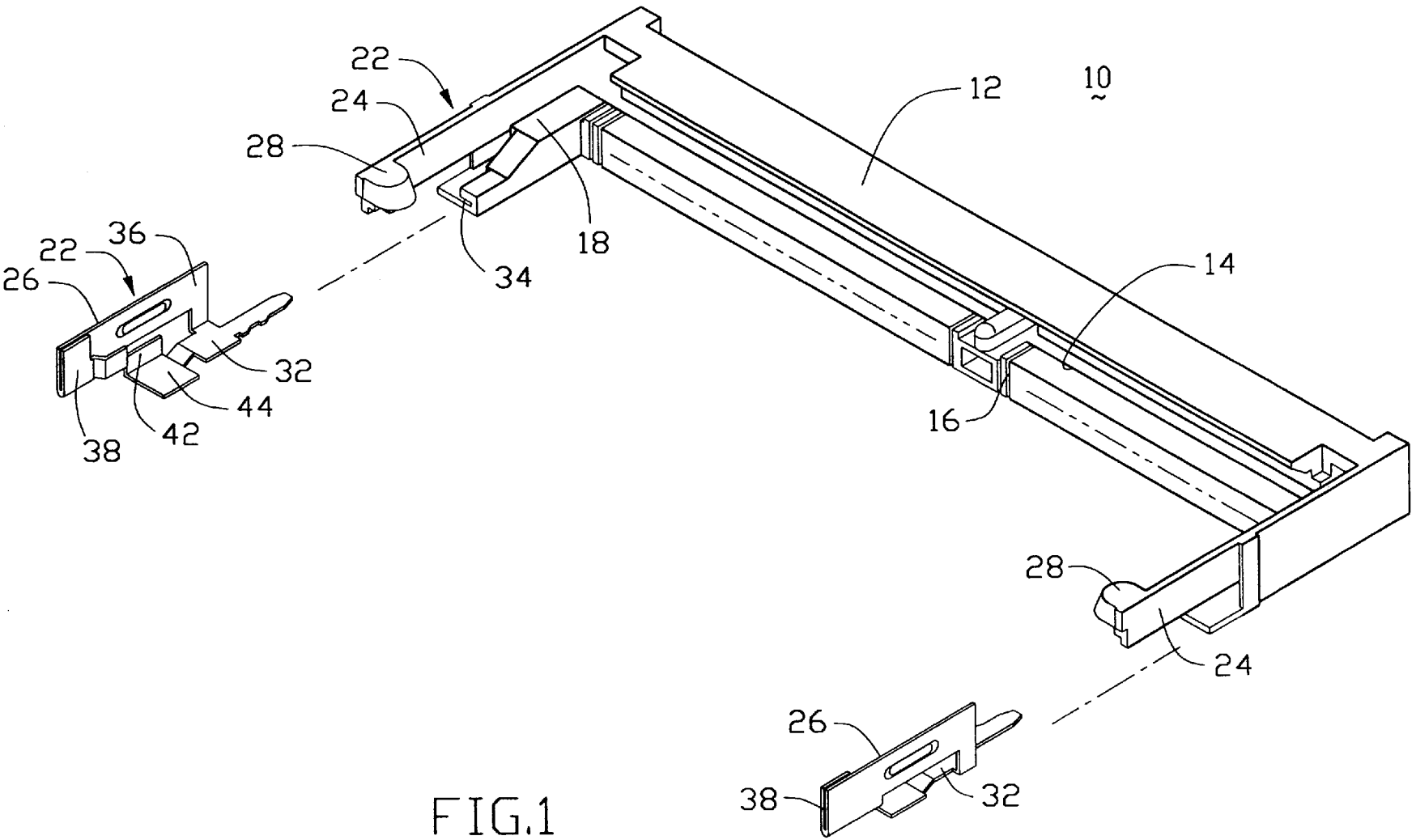
FIG. 1 is an exploded top perspective view of a presently preferred embodiment of a connector, according to the invention.
Figure 2:
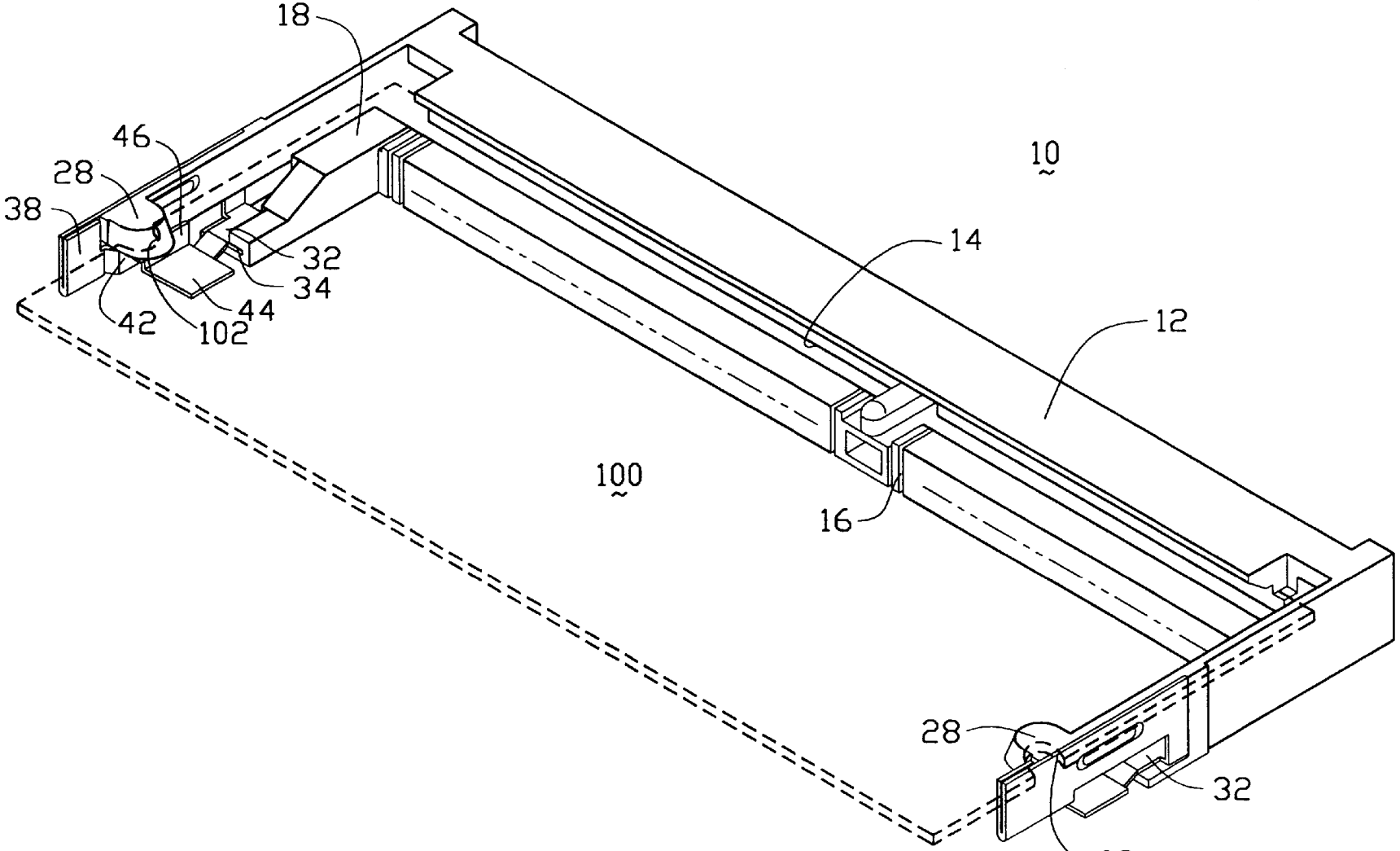
FIG. 2 is an perspective view of the assembled connector of FIG. 1.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Understandably, the basic structure of the connector, and the interaction between the module and the connector can be referred to the aforementioned copending application. Attention is directed to FIGS. 1–4 wherein an electrical connector 10 includes an insulative housing 12 defining a central slot 14 for receiving a module 100 therein.

Two rows of passageways 16 are provided by two sides of the central slot 14 to receive therein a corresponding number of contacts (not shown) for engagement with the corresponding circuit pads on the module. A pair of platforms 18 are provided adjacent to two opposite ends of the housing 12 for allowing the module 100 to be generally seated thereon. A latch device 22 including a resilient plastic member 24 and a resilient metal member 26, is disposed at two opposite ends of the housing 12 wherein the plastic member 24 extends integrally by the outer side of the platform 18.

The plastic member 24 includes a locking head 28 at the distal end, and a arch-like protrusion 30 formed under the locking head 28 wherein the arch-like protrusion 30 complies with a corresponding notch 102 in the side edge of the module 100. Thus, when the module 100 is fully received within the central slot 14 and completely latched by the locking head 28, the arch-like protrusion 30 (FIGS. 3 & 4) is substantially received within the notch 102 of the module 100 for prohibiting the front-to-end horizontal movement of the module 100 with regard to the housing 12.

The metal member 26 includes a horizontal retention section 32 with barbs thereon for interferential engagement within a horizontal groove 34 in the corresponding platform 18, and a vertical resilient body 36 closely positioned by the outer side of the plastic member 24. The resilient body 36 of each metal member 26 abuts against an outer surface of the plastic member 24 thereby being fully exposed to an exterior, and the pair of resilient bodies 36 of the metal member 26 together define the full/maximum lengthwise dimension of the connector 10, said lengthwise dimension being measured from the exterior edge of one resilient body 36 to the exterior edge of the opposite resilient body 36.

Figure 3:
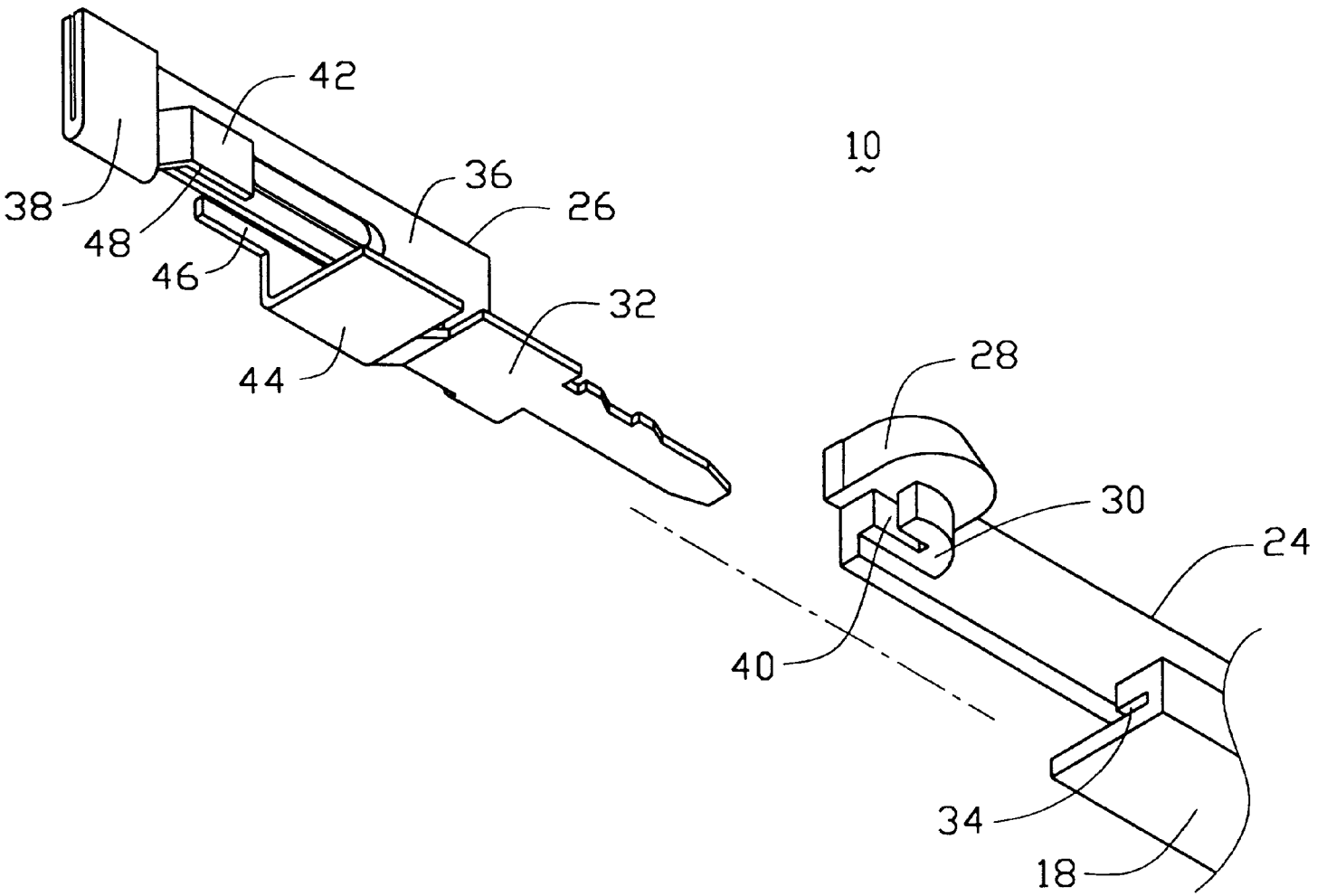
FIG. 3 is an enlarged partial exploded bottom perspective view of the connector of FIG. 1.
Figure 4:
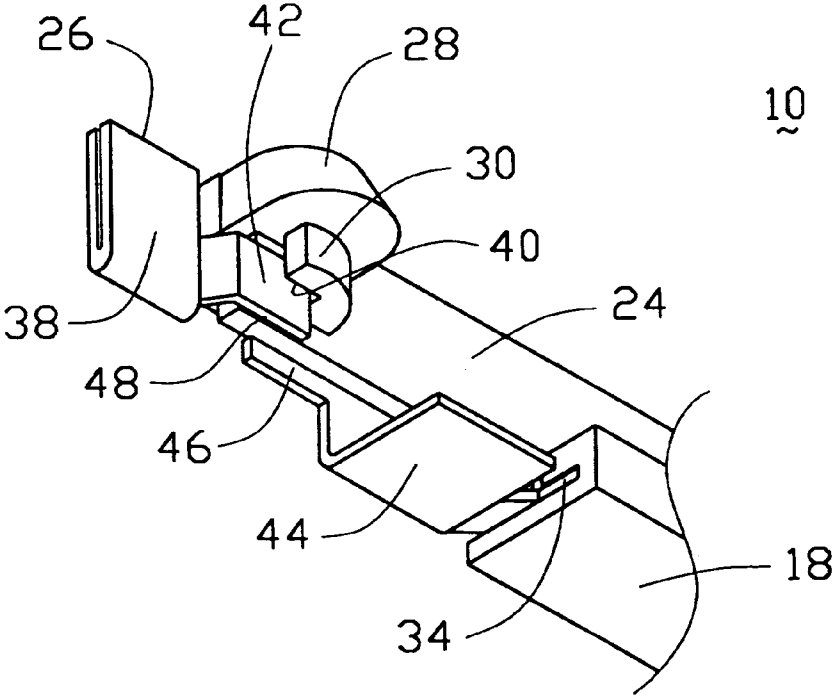
FIG. 4 is an enlarged partial bottom perspective view of the assembled connector of FIG. 1.

A lever section 38 is formed at the distal end of the metal member 26 by an upward folding procedure, and is substantially positioned in front of and in abutment with the locking head 28 of the plastic member 24. An engagement structure is provided under the locking head 28 of the plastic member 24 to interlock the plastic member 24 and the metal member 26 for collaborative linking-up therebetween (FIGS. 3 & 4). The engagement structure includes a slit 40 in the arch-like protrusion 30 and a lance 42 integrally extending rearward from the lever section 38 of the metal member 26 adapted to be receivably retained within the slit 40. Therefore, when the lever section 38 is manually urged to move outward, the plastic member 24 can be actuated to synchronously move outward and have the module 100 released from the locking head 28 of the connector 10.

Additionally, because of removing the original end wall of the housing in the copending application design, it is required to have the other corresponding means providing the stopper function in stead of the end wall of the previous design. In this embodiment, the retention section 32 further includes a mounting section 44 extending out of the groove 34 in the platform 18 and adapted to be mounted onto the mother board (not shown). A stopper wall 46 extends upward and forward from the mounting section 44 for confrontation with the lower portion 48 of the lance 42, thus preventing the resilient body 36 of the metal member 26 with the plastic member 24 from over-laterally/outwardly moving.

It is appreciated that the invention provides a dimension-reduced structure along the lengthwise direction while still maintaining the interaction between the plastic member and the metal member without resulting in any interference with the inserted module.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. An electrical connector for retaining a module therein, comprising:

an insulative housing defining a central slot for receiving said module therein;

a plurality of contacts disposed by two sides of the central slot;

a pair of latch devices provided at two opposite ends of the housing;

each of said latch devices including a plastic member and a metal member, the metal member forming a lever section at a distal end thereof for manual operation; wherein said plastic member extends from a lateral edge of the housing, and includes a locking head and an engagement structure generally under said locking head and being received within a corresponding notch defined in a side edge of the module for engaging with both the plastic member and the metal member, the engagement structure comprising a slit and, a lance integrally extending rearward from the lever section of the metal member for engaging with the slit of the engagement structure of the plastic member, thereby retaining the plastic member with the metal member, and wherein the engagement structure includes an arch-like protrusion under the locking bead for engaging with the notch in the side edge of the module thereby prohibiting a front-to-end movement of the module with regard to the housing.

2. The connector as defined in claim 1, wherein said each metal member includes a vertical resilient body with a lever section formed at a distal end, said lever section being substantially positioned in front of and in abutment with the locking head of the plastic member for manual operation thereon.

3. The connector as defined in claim 1, wherein each metal member includes a horizontal retention section with barbs thereon for engagement within a corresponding horizontal groove defined in the housing.

4. The connector as defined in claim 1, wherein a pair of platforms is provided adjacent to two opposite ends of the housing and a horizontal groove is formed in each of said platforms for receiving a horizontal retention section formed on the metal member.

5. The connector as defined in claim 3, wherein a mounting section extends from each horizontal retention section for being mounted to a mother board on which the connector is mounted.

6. The connector as defined in claim 5, wherein a stopper wall extends upward and forward from the mounting section for confrontation with a lower position of the lance of each metal member thereby preventing the lance of the metal member and the plastic member from over-laterally movement.

7. An electrical connector for retaining a module therein, comprising:

an insulative housing defining a central slot for receiving said module therein;

a plurality of contacts disposed by two sides of the central slot;

a pair of latch devices provided at two opposite ends of the housing, each of said latch devices including a platform;

each of said latch devices including a resilient plastic member and a metal member mounted to the plastic member, the plastic member comprising a locking head for engaging with a corresponding notch defined in a side edge of the module;

each metal member including a horizontal retention section with barbs thereon for engaging within a horizontal groove defined in the corresponding platform and a vertical resilient body, said vertical resilient body closely abutting against an outer side of a corresponding plastic member and movable sidewardly with the plastic member; whereby the vertical resilient bodies of the opposite metal members are respectively exposed to an exterior, and commonly define a maximum lengthwise dimension of the connector, wherein an arch-like engagement protrusion is formed under the locking head of the plastic member for being received within the notch of the module thereby prohibiting a front-to-end movement of the module with regard to the housing.

8. The connector as defined in claim 7, wherein each vertical resilient body includes a lance extending therefrom for engagement with the plastic member, a mounting section integral with the horizontal retention section for being mounted to a mother board on which the connector is mounted, and a stopper wall extending upward from the mounting section for confrontation with a lower portion of the lance thereby preventing the metal member and the plastic member from over-outwardly moving.

9. The connector as defined in claim 7, wherein the vertical resilient body of each metal member includes a lever section formed at a distal end of the said vertical resilient body and substantially positioned in front of and in abutment with the locking head of the plastic member for facilitating manual operation thereon.

10. The connector as defined in claim 7, wherein a lance integrally extends rearward from the lever section of the metal member for engaging with a slit defined in the engagement protrusion of the plastic member.

11. An electrical connector for retaining a module therein, comprising:

an insulative housing defining a central slot for receiving said module therein;

a plurality of contacts disposed by two sides of the central slot;

a pair of latch devices provided at two-opposite ends of the housing, each latch device comprising a plastic member including a locking head, and a metal member;

said metal member including a vertical resilient body fastened to the housing through a horizontal retention section, said vertical resilient body being closely positioned to an outer side of the corresponding plastic member and movable along with the corresponding plastic member; wherein the vertical resilient body includes a lever section for facilitating manual operation thereon and a lance extending rearward from the lever section for engagement with the plastic member, the lance being adapted to be further engaged with a stopper wall extending from the retention section when the vertical resilient body is deflected outward, and wherein an arch-like engagement protrusion is formed under the locking head of the plastic member for being received within the notch of the module thereby prohibiting a front-to-end movement of the module with regard to the housing.

* * * * *